United States Patent [19]

Yang

[11] Patent Number: 5,072,160

[45] Date of Patent: Dec. 10, 1991

[54] DEVICE FOR PERIODICALLY ALTERNATING BULB POLARITIES OF A DC FLUORESCENT LIGHTING SYSTEM

[76] Inventor: Tai-Her Yang, 8-1 Taipin Street, Si-Hu Town, Dzan-Hwa, Taiwan

[21] Appl. No.: 575,425

[22] Filed: Aug. 29, 1990

Related U.S. Application Data

[63] Continuation-in-part of Ser. No. 218,213, Jul. 13, 1988.

[51] Int. Cl.[5] ..... H05B 41/16; H05B 41/36

[52] U.S. Cl. ..... 315/287; 315/246; 315/307; 315/DIG. 5; 315/DIG. 7

[58] Field of Search ..... 315/287, 205, 224, 246, 315/137, 307, 170, 171, DIG. 5, DIG. 7, 209 R

[56] References Cited

U.S. PATENT DOCUMENTS

| | | | |
|---|---|---|---|
| 3,999,100 | 10/1976 | Dendy et al. | 315/205 X |
| 4,327,309 | 4/1982 | Wallot | 315/170 |
| 4,356,432 | 10/1982 | Vinarub | 315/287 |
| 4,914,356 | 4/1990 | Cockram | 315/307 |

*Primary Examiner*—Eugene R. LaRoche
*Assistant Examiner*—Ali Neyzari
*Attorney, Agent, or Firm*—Leonard Bloom

[57] ABSTRACT

A device for alternating the polarity of a regulated DC power signal applied to a fluorescent light system, which device selectively reverses the polarity of a DC power signal applied to a fluorescent lamp each time the light system is turned on and an AC power signal is applied. The device selects the polarity of the DC power signal applied to the lamp such that both terminals of the lamp act as a cathode approximately an equal number of times, thus preventing premature aging and degradation of any one lamp terminal.

9 Claims, 2 Drawing Sheets

DEVICE FOR PERIODICALLY ALTERNATING BULB POLARITIES OF A DC FLUORESCENT LIGHTING SYSTEM

CROSS REFERENCE TO RELATED APPLICATIONS

This application is a continuation-in-part of parent application Ser. No. 218,213 filed July 13, 1988, now abandoned.

BACKGROUND OF THE INVENTION

1. Field of the Invention

The present invention relates to an improvement in DC lighting, and more particularly to a device for alternating the polarity of a DC power signal prior to powering a fluorescent bulb.

2. Description of Related Art

Conventional fluorescent lighting systems may operate from either AC or DC power. However, if AC power is applied to a fluorescent tube, the alternating signal results in flickering of the light given off by the bulb. Over a period of time, flickering may result in harm to the eyes. Conventional DC fluorescent lighting systems solve this problem by applying a constant signal to the fluorescent bulb, thereby continuously driving the bulb. Since the driving signal does not alternate there is no flickering of the light given off by the bulb. Despite the great advantage of the DC fluorescent lighting system a significant problem is presented. If the fluorescent bulb is always biased by the DC power signal in the same directions severe aging and degradation of the cathode results. It would be greatly advantageous to provide a device for alternating the polarity of the DC power signal upon application to the fluorescent bulb which does not cause a significant amount of flicker. Such a device would prevent premature aging of the cathode of the bulb and yet provide a constant lighting source.

Accordingly, it is an object of the present invention to provide a circuit for selectively alternating the polarity of a DC power signal applied to a fluorescent bulb each time power is applied to the bulb.

It is another object of the present invention to alternate the aforesaid polarity by both manually and electrically operated means.

SUMMARY OF THE INVENTION

In accordance with the presently preferred embodiment, the foregoing objects, features and advantages are achieved by providing a circuit for randomly determining the polarity of a DC power signal to be applied to a lamp, the circuit including a power supply for converting an AC power signal into a regulated DC power signal capable of driving a lamp, a switch connected to the power supply for selectively reversing the polarity of the DC power signal each time the AC power signal is applied, polarity control means for randomly selecting the polarity of the DC power signal, said polarity control means being connected to the switch for controlling the switch in accordance with the random selection, and a lamp continuously powered by the DC power signal which has a polarity selected by the polarity control means.

BRIEF DESCRIPTION OF THE DRAWINGS

Other objects, features and advantages of the present invention will become more apparent from the following detailed description of preferred embodiments and certain modifications thereof when taken together with the accompanying drawings, in which.

To appreciate and understand the present invention fully, the following detailed description of the presently preferred exemplary embodiments should be studied in conjunction with the drawings.

DETAILED DESCRIPTION OF THE PREFERRED EMBODIMENTS

Figure 1:
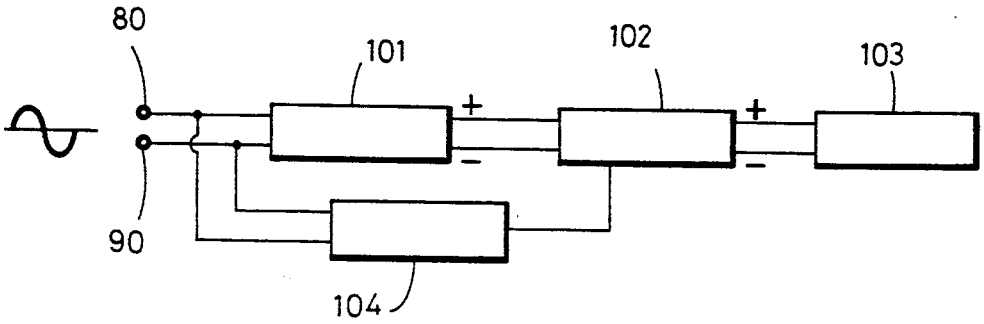
FIG. 1 is a functional block diagram illustrating a fluorescent lighting system in accordance with the present invention.

As shown in FIG. 1, terminals 80 and 90 are connected to power supply 101, which in turn is connected in parallel to switching circuit 102 and lamp 103. A polarity control circuit 104 is also connected in parallel to input terminals 80 and 90, and polarity control circuit 104 operates to selectively activate the switching circuit 102 at a time when an AC power signal is first applied to input terminals 80 and 90. In operation, when the AC input signal is first applied to terminals 80 and 90, there is an equal probability that the signal will be positive as opposed to negative. If the signal is positive when first applied to the input terminals 80 and 90 polarity control circuit 104 operates to cause switching circuit 102 to reverse the polarity of the DC input signal applied to lamp 103.

Figure 2:
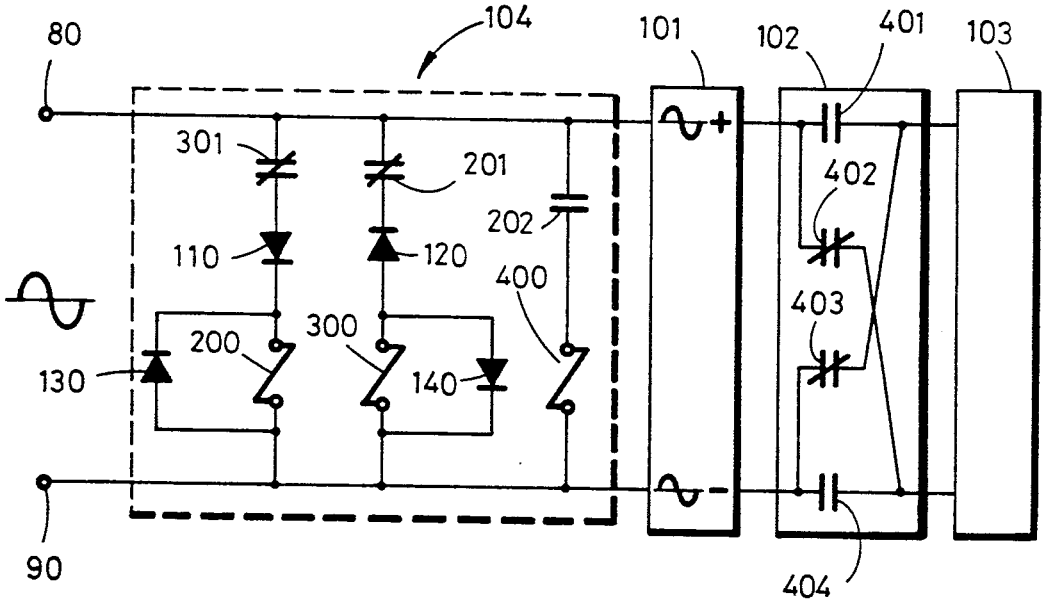
FIG. 2 is a schematic diagram showing a preferred embodiment of the polarity control means of FIG. 1.

This can be more clearly seen with reference to FIG. 2, which illustrates a schematic diagram of both the polarity control circuit 104 and switching circuit 102. As can be seen, the polarity control circuit includes two relays 200 and 300 each protected by respective diodes 130 and 140. Relay 200 is connected in series with diode 110 and contacts 301 which are operated by relay coil 300. The series connected components are connected in parallel across input terminals 80 and 90 relay coil 300 is connected in series with diode 120 and relay contacts 201 which are operated by relay coil 200. These three series connected components are connected in parallel across input terminals 80 and 90. Relay 400 is connected in series with relay contacts 202 which are normally open relay contacts energized by relay coil 200. These two components are also connected in parallel across input terminals 80 and 90. In operation, an AC input signal is applied across input terminals 80 and 90. If the AC input signal is positive, current flows through normally closed contacts 301 and diode 110 and excites relay coil 200 thereby causing normally closed relay contacts 201 to open and normally open relay contacts 202 to close. Once this occurs, relay coil 300 is affectively removed from the circuit and relay coil 400 is energized by current flowing through relay contacts 202. With relay coil 300 removed from the circuit, relay coil 200 continues to energize relay contacts 201 and 202, thereby energizing relay coil 400. Relay coil 400 operates relay contacts 401 through 404 of switching circuit 102. When relay coil 400 is energized, normally open relay contacts 401 and 404 are closed and normally closed relay contacts 402 and 403 are open. Thus, the regulated DC input signal passes through switching circuit 102 and the polarity is not changed as it is applied to lamp 103. The polarity of the DC input signal applied to lamp 103 remains constant as long as power remains applied to terminals 80 and 90 (despite the fact that the signal applied at terminals 80 and 90 alternates). However, if the AC input signal is removed from terminals 80 and 90 and is later reapplied, there is an equal probability that the signal would be applied at a time when it is negative. If this is so, then current flows through relay coil 300, diode 120 and normally closed relay contacts 201. Energized relay coil 300 opens contacts 301 thereby removing relay coil 200 from the circuit. Therefore, normally opened relay contacts 202 remain open and relay coil 400 cannot be energized. Because relay coil 400 is not energized, normally open relay contacts 401 and 404 of switching circuit 102 remain open, and normally closed contacts 402 and 403 remain closed. In this case the switching circuit 102 reverses the polarity of the DC input signal as it is applied to lamp 103. The polarity remains reversed as long as the AC input signal is applied to input terminals 80 and 90 (despite the fact that input signal applied to those terminals alternates). It can be seen that the polarity of the DC input signal applied to lamp 103 may alternate each time an AC input signal is applied to terminals 80 and 90. The probability that the DC input signal applied to lamp 103 will be reversed is equal to the probability that it will not be reversed because there is an equal probability that the AC input signal will be positive when applied to terminals 80 and 90 as opposed to negative. Over time, this prevents the aging and degradation of the cathode of fluorescent lamp 103 which would occur if the polarity were never reversed.

Figure 3:
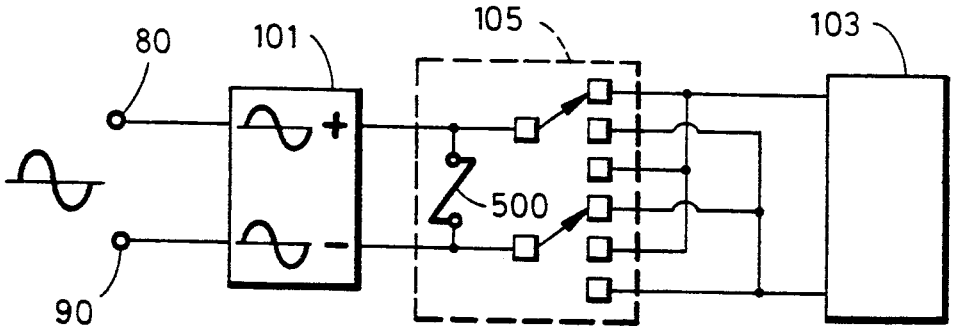
FIG. 3 is a schematic diagram showing a preferred embodiment of a step switch.

FIG. 3 illustrates another embodiment of the present invention in which step relay 105 is substituted for polarity control circuit 104 and switch circuit 102. Step relay 105 is preferably a two pole rotary relay having a pole connected to each of the input terminals 80 and 90. Each time an AC signal is applied to relay coil 500, coil 500 steps the connection to the next adjacent set of contacts. The contacts are wired as shown in FIG. 3 so that each time a DC signal is applied from power supply 101 to relay coil 500 the relay steps its contacts by one set thereby alternating the polarity of the DC signal applied to lamp 103. In this manner, step relay 105 insures that the polarity applied to lamp 103 is reversed each time in AC signal as applied at input terminals 80 and 90, thereby preventing degradation and premature aging of the lamp cathode.

Figure 4:
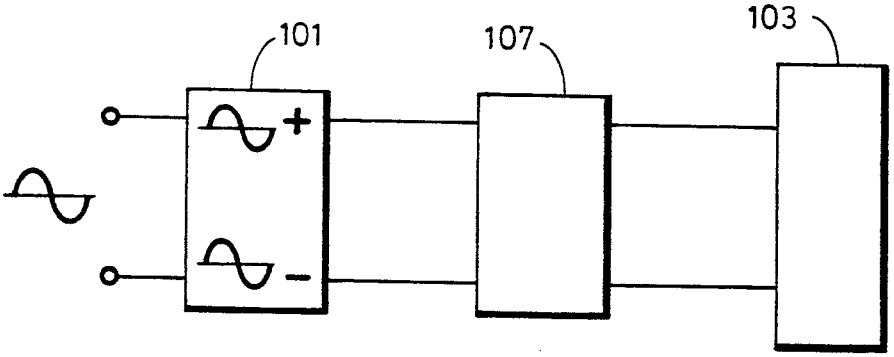
FIG. 4 depicts a fluorescent lighting system incorporating a timing signal generator and switch means according to another embodiment of the present invention.

FIG. 4 depicts a simple alternative to step relay 105 which incorporates a manual switch 107. Manual switch 107 is configured so that an operator manually performs the function of relay coil 500. Switch 107 includes double poles and contacts which are similarly configured. With manually operated switch 107 the operator simply activates switch 107 each time that the fluorescent lighting system is activated.

Figure 5:
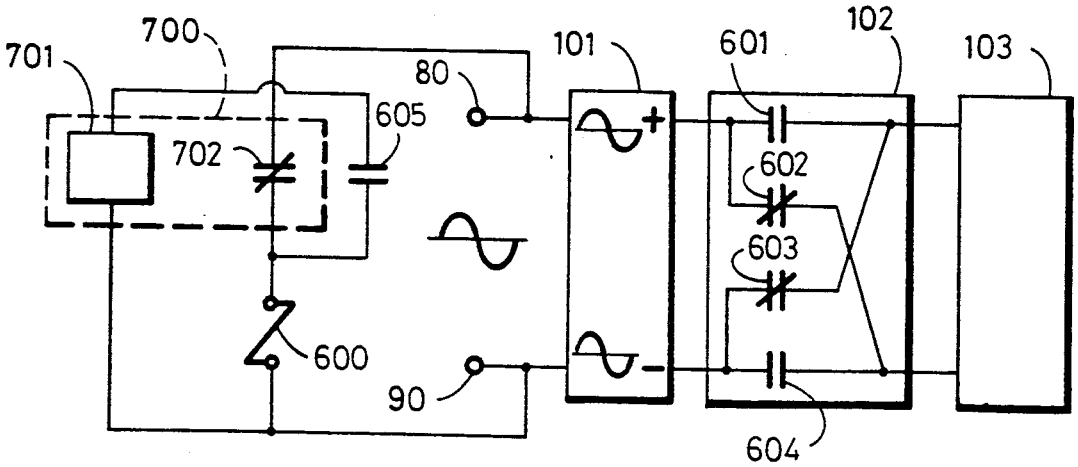
FIG. 5 is a schematic diagram showing an alternate embodiment of the switching means incorporating a manually operated switch.

FIG. 5 illustrates another embodiment of the present invention which uses switch circuit 102 and timing circuit 700 to accomplish its purpose. Input terminals 80 and 90 are coupled in parallel through power supply 101 to switch circuit 102. Switch circuit 102 comprises a pair of normally opened relay contacts 601 and 604 wired in cross-coupled formation with normally closed relay contacts 602 and 603. Switch circuit 102 is connected in parallel to lamp 103. Timing circuit 700 comprises a timing signal generator 701 and normally closed relay contacts 702. Relay contacts 702 are coupled in series with relay coil 600 between input terminals 80 and 90. Timing signal generator 701 is connected between timing circuit contact 702 and relay coil 600 through normally open relay contacts 605. Timing signal generator 701 is also connected to input terminal 90. In operation, an AC input signal is applied at input terminals 80 and 90. The AC input signal energizes relay coil 600 which acts to close relay contacts 605. The AC power signal is applied through relay contacts 702 and relay contacts 605 to timing signal generator 701. Upon receipt of the AC power signal, timing signal generator 701 counts off a preset interval before opening contacts 702. Once relay contacts 702 are open, relay coil 600 is effectively removed from the circuit and relay contacts 601 and 604 are closed while relay contacts 602 and 603 are open, thereby reversing the polarity of the DC input signal applied to lamp 103. At the same time, relay contacts 605 are closed thereby cutting off timing signal generator 701 which prevents any further reversing of the polarity of the DC power signal.

Each of the aforesaid embodiments of the invention select and control the polarity of the DC signal applied to the lamp 103 at the moment that AC power is applied. Over time the number of times each lamp terminal is used as a cathode is approximately equal. Therefore there is no degradation or premature aging of any one terminal. As a result the lamp 103 may be expected to have a longer life.

While the present invention has been described in connection with what is presently considered to be the most practical and preferred embodiments, it is to be understood that the invention is not to be limited to the disclosed embodiments. Rather, the invention is intended to cover various modifications and equivalent arrangements included within the spirit and scope of the appended claims.

What is claimed is:

1. A circuit for receiving an AC power signal and converting said AC power signal into a regulated DC power signal capable of driving a lamp, and for randomly determining a polarity of said AC power signal when said AC power signal is initially received, comprising:

power supply means for receiving an AC power signal and converting said AC power signal into a regulated DC power signal capable of driving a lamp;

switch means connected to said power supply means for receiving said DC power signal and for controllably reversing polarity of said DC power signal when said AC power signal is received by said power supply;

polarity control means for randomly selecting a polarity of said DC power signal, said polarity control means being connected to said switch means for controlling said switch means in accordance with said random selection; and a lamp connected to said switch means for illumination by said DC power signal having a polarity selected by said polarity control means.

2. The circuit according to claim 1, wherein said polarity control means selects said polarity of said DC power signal in accordance with an initial polarity of said AC signal when said AC signal is first applied to said power supply, said initial polarity of said AC signal randomly being one of a first polarity and a second polarity.

3. The circuit according to claim 2, wherein said polarity control means comprises a first input terminal and a second input terminal for receiving said AC power signal, a first diode and a second diode, a first relay having a coil, normally open contacts and normally closed contacts, a second relay having a coil and normally closed contacts, and a third relay coil, said normally closed second relay contacts, first diode and first relay coil being connected in series between said first and second input terminals, said normally closed first relay contacts, second diode and second relay coil being connected in series between said first and second input terminals, and said normally open first relay contacts and third relay coil being connected in series between said first and second input terminals, and said switch means comprises a first input terminal and a second input terminal, a first output terminal and a second output terminal, a pair of normally open contacts and a pair of normally closed contacts of said third relay, said first and second input terminals each being connected to said first and second output terminals, respectively, through one contact from one of said pairs of contacts, and said first and second input terminals each being connected to said second and first output terminals, respectively, through one contact from another of said pairs of contacts;

whereby said third relay coil of said polarity control means is selectively energized in accordance with an initial value of said AC input signal when first applied, said switch means thereby operating to reverse polarity of said DC power signal when said third relay coil is energized.

4. A circuit for receiving an AC power signal and converting said AC power signal into a regulated DC power signal capable of driving a lamp, and for changing a polarity of said DC power signal each time said AC power signal is initially received, comprising:

power supply means for receiving an AC power signal and converting said AC power signal into a regulated DC power signal capable of driving a lamp;

step switch means connected to said power supply means for receiving said DC power signal and for reversing a polarity of said DC power signal each time said AC power signal is initially applied;

a lamp connected to said switch means and energizable by said DC power signal having a polarity specified by said switch means.

5. The circuit according to claim 4, wherein said step switch means comprises a first input terminal, a second input terminal, a first output terminal, a second output terminal, and a manually operable double-pole switch, said switch having a first pole connected to said first input terminal and a second pole connected to said second input terminal, and having a plurality of contacts alternately connected to said first and second output terminals, whereby each time said switch is manually operated said poles are connected to alternate output terminals thereby reversing the polarity of the DC power signal applied to said lamp.

6. The circuit according to claim 4, wherein said step switch means comprises a first input terminal, a second input terminal, a first output terminal, a second output terminal, and a double-pole step relay, said relay having a first pole connected to said first input terminal, a second pole connected to said second input terminal and a coil connected therebetween, and said relay further comprising a plurality of contacts alternately connected to said first and second output terminals, whereby each time said AC power signal is applied to said input terminals and coil said relay operates to connect said poles to alternate output terminals thereby reversing the polarity of the DC power signal applied to said lamp.

7. The circuit according to claim 6, wherein said step relay is a continuous rotary relay.

8. A circuit for receiving an AC power signal and converting said AC power signal into a regulated DC power signal capable of driving a lamp, and for randomly determining a polarity of said DC power signal when said AC power signal is initially received, comprising:

power supply means for receiving an AC power signal and converting said AC power signal into a regulated DC power signal capable of driving a lamp;

switch means connected to said power supply means for receiving said regulated DC power signal and for selectively reversing polarity of said DC power signal when said AC power signal is received by said power supply;

timing signal generating means for generating a timing signal;

polarity control means for selecting a polarity of said DC power signal, said polarity control means being connected to said switch means and to said timing signal generating means for controlling said switch means in accordance with a voltage of said timing signal;

a lamp connected to said switch means and energizable by said DC power signal having a polarity selected by said polarity control means.

9. The circuit according to claim 8, wherein said polarity control means selects said polarity of said DC power signal in accordance with a voltage of said timing signal at a time when said AC signal is initially applied to said power supply.

* * * * *